US008763688B2

(12) United States Patent
Webb, Jr.

(10) Patent No.: US 8,763,688 B2
(45) Date of Patent: Jul. 1, 2014

(54) HIGH PRESSURE OIL PIPE BULLET PLUG

(76) Inventor: John Karl Webb, Jr., Pensacola, FL (US)

( * ) Notice: Subject to any disclaimer, the term of this patent is extended or adjusted under 35 U.S.C. 154(b) by 339 days.

(21) Appl. No.: 13/136,648

(22) Filed: Aug. 5, 2011

(65) Prior Publication Data

US 2012/0043074 A1 Feb. 23, 2012

Related U.S. Application Data

(60) Provisional application No. 61/400,992, filed on Aug. 5, 2010.

(51) Int. Cl.
*E21B 33/12* (2006.01)

(52) U.S. Cl.
USPC ..... 166/192; 166/386; 166/80.1; 166/332.8

(58) Field of Classification Search
USPC ..... 166/192, 386, 101, 106, 80.1, 332.8
See application file for complete search history.

(56) References Cited

U.S. PATENT DOCUMENTS

| | | | | |
|---|---|---|---|---|
| 4,279,304 | A * | 7/1981 | Harper | 166/301 |
| 4,620,593 | A * | 11/1986 | Haagensen | 166/248 |
| 2005/0000692 | A1 * | 1/2005 | Cook et al. | 166/300 |
| 2005/0194143 | A1 * | 9/2005 | Xu et al. | 166/285 |
| 2006/0108115 | A1 * | 5/2006 | Johnson | 166/278 |

* cited by examiner

*Primary Examiner* — Yong-Suk (Philip) Ro

(57) ABSTRACT

A rubber bullet-shaped cylindrical device that functions to non-invasively plug a gushing pipe of high pressure oil. The steel belted inflatable rubber plugging device with attached high pressure hoses is inserted into a gushing oil well pipe while it pumps shipboard a high pressure stream of recycled oil itself that will not freeze at the gushing oil well to fight or knife through the oil and the pressure of the oil gushing to assist with inserting and descending the apparatus into the pipe while the operator follows a sequence of operational steps. A hose that has a vacuum applied to reduce the size of the inflatable bladder to allow it to fit it into the pipe unrestricted until it stops at the right location then recycled oil that will not freeze is pumped into the bladder to seal the oil well and to allow the cement pouring operation.

35 Claims, 10 Drawing Sheets

HIGH PRESSURE OIL PIPE BULLET PLUG

RELATED APPLICATIONS

The present application is a continuation-in-part application of United States provisional patent application Ser. No. 61/400,992, filed Aug. 5, 2010, for HIGH PRESSURE OIL PIPE BULLET PLUG, by John K. Webb, Jr., John K. Webb, III, included by reference herein and for which benefit of the priority date is hereby claimed.

FIELD OF THE INVENTION

The present invention relates to an apparatus that works in a closed system that is designed to stop the flow of oil and other liquids under high pressure facilitating the permanent plugging of a gushing oil well, and, more particularly, to stop oil gushing from an out of control deepwater oil well.

DESCRIPTION OF THE RELATED ART

Controlling the flow of oil, liquids and gases that may have sand or gravel and other materials during subterranean oil well completion is very important in the Related art referenced. There is no mention of using related art in subsea oil wells from the patents referenced, and the devices and methods that they use are not for permanently plugging an out-of-control well on land or subsea.

US patent 20060108115 entitled "System and Method for fracturing and gravel packing a wellbore", relates to completing a subterranean oil or gas well, and discusses using a one-way flow device or check valve, called the flow control valve that is used during completion of a new well. US patent number 20050194143 entitled "One trip perforating, cementing, and sand Management apparatus and method" discusses stopping fluid flow through a landing assembly that has a plug that is releasable and a flow actuated shifting mechanism that is adapted to selectively stop fluid flow through an orifice and this is all used during the completion of a subterranean oil well. US patent number 20050000692, "Spiral tubular tool and method" discusses a down hole device that contains a one-way valve so that a flow stream from the well bore is allowed to flow in a first direction but not from flowing in a second direction and also sealingly engaging an elastomeric member against the inner wall of an oil well casing. U.S. Pat. No. 4,620,593, "Oil recovery system and method", discusses how the amount of radiation controls the flow of oil during oil well production from a petroleum-bearing subterranean formation. U.S. Pat. No. 4,279,304, entitled "Wire line tool release Method" mentions forcing oil through a damping orifice or a restriction and also mentioned is allowing well fluid in the well bore to flow between a tool and a hole.

Referenced related art patents are for building and completing a subterranean oil well rather than for permanently plugging them, but they are relied upon for their capabilities in restricting flow in a pipe or tubular.

BACKGROUND OF THE INVENTION

A deepwater oil well riser pipe is gushing oil into the ocean at approximately 10,000 pounds per square inch (PSI) with approximately 53,000 barrels of oil per day coming out of a 21 inch riser pipe. Not having an early response or having to wait over 1 day, let alone 90 days on a major deepwater oil spill is not acceptable when the equipment is simple to use and available to immediately and permanently stop the oil leak possibly within a number hours instead of months. There is a chance that it will probably happen in the future accidentally through incompetence or intentionally through negligence or terrorism. There are too many variables to take a chance and not have the equipment and solution waiting in place. If it is needed to drill in the ocean then we should have what it takes to fix problems and fix them immediately when it happens. Drilling extra holes in the seabed to pour heavy mud and cement is extra time and money and does not guarantee success and would be unnecessary if the bullet plug is ready to deploy. Having ships available to collect oil from the leak or leaks does not solve the problem and more oil escapes into the sea water or environment. Long-term effects will be for years with a large oil spill for animals, plant life, and human beings, and the loss of a 40 billion dollar seafood industry and hundreds of thousands of jobs. A compact easy to install oil well plugging device is needed, and it is also a backup to the blow-out preventer that is supposed to be the last line of defense against a leaking deepwater oil well.

Pouring heavy mud and cement down the throat of the blown-out well to do what the industry calls a static kill. Drilling two relief wells as a backup just in case the blown-out well cannot be sealed, and they will need to also have heavy mud and cement poured into them if they have reached the original oil well hole. Installing a 150,000 pound cap or large heavy object or large heavy hollow container on the ocean floor over the oil well riser or using a cofferdam to stem the flow of oil to be collected by ships is not an effective solution. The High Pressure Oil Pipe Bullet Plug is not considered a cap, and it is intended to permanently seal the leaking oil well and not temporarily to prevent having to do more dangerous undersea drilling at a later time.

Any solution that leaves the oil well leaking or gushing proves very costly and dangerous to the environment, oil industry personal and people who live on the coast near the oil spill. Hurricanes sometimes prevent progress of a process that takes more than a month like drilling relief wells that could take over 90 days. There needs to be quick and decisive way to plug the oil leak with a potential of 53,000 barrels of oil leaking into the sea each day, time is of the essence. Drilling relief wells, pouring heavy mud and cement, installing a 150,000 pound cap over the oil riser, installing a large heavy hollow container over the well, and using a cofferdam to stem the flow of oil have shown to be very costly and cannot be considered a quick response.

SUMMARY OF THE INVENTION

In accordance with the present invention, there is provided a functional bullet-shaped plugger device used to temporarily plug the pipe's oil flow below riser's damage for an ample time so that injected cement will cure to permanently seal oil well from installed Bullet Plug's top. The Bullet Plug is used to counter and stabilize this gushing oil with high velocity/high pressure oil stream from ship(s) during and after its installation. After installation is that time for cement pouring and curing inside the oil well riser. The present invention uses shipboard equipment and connects to hoses that could be the same equipment that could be used for a ground oil well if it was on land. The steel-belted ribbed rubber bladder is proportionally large enough depending on the size of the oil well pipe to enter and go to a certain depth with some assistance from oil knife or stream being pumped at the well's gushing oil from the pipe and nozzle in the center of the bullet plug to reduce pressure and allow ease of insertion, and also getting some assistance from the sectional struts. The collapsed bladder is finally inflated with oil to expand 360 degrees from a lower pressure shipboard oil pump when the bullet plug is at the proper depth in the oil well pipe while maintaining at a high pressure the oil knife or stream flow at the oil well coming out of the center of the bullet plug lowering the pressure of the oil well while bullet plug is expanded up against the inside walls of the oil pipe to plug the oil well and hold steady while cement is poured over the bullet plug to permanently stop flow of oil or kill the oil well and prevent millions of gallons of oil from leaking into the sea.

It would be advantageous to provide a reliable oil well plugging device.

It would also be advantageous to provide a fast deployable low cost oil well plugging device that could be standard equipment in the oil exploration industry.

It would further be advantageous to provide an oil plugging device and system that uses the recycled oil from the well that will not freeze to fight the oil from the well.

It would further be advantageous to provide an oil plugging device and system that uses the recycled oil from the well that will not freeze to inflate the bullet plug to plug the oil well pipe.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
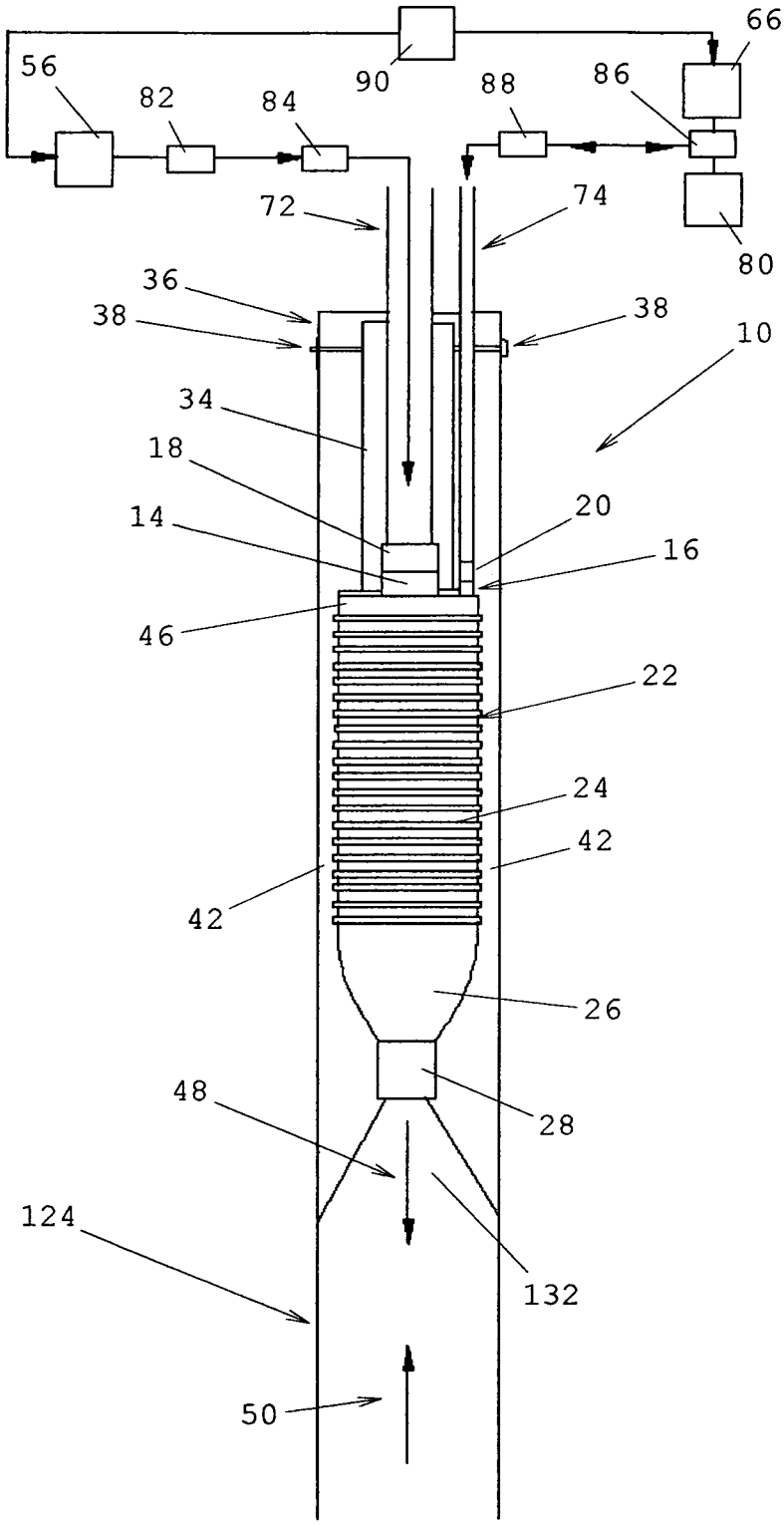
FIG. 1 is a front perspective view of a bullet plugging device in a closed loop system in accordance with the invention.

FIG. 1 shows one application of the invention used when Oil well control has failed at a subsea oil well, and a device is used to plug or kill the subsea oil well that may be leaking oil and liquids from well stream in excess of 10,000 pounds per square inch (PSI). FIG. 1 is a perspective view of a bullet plug 10 inserted into an oil well riser top 36 pipe in accordance with the invention, and this is prior to plugging an oil well. There are 3 shipboard hose connections to the bullet plug 10 from shipboard equipment 92 FIG. 9 that is typically available on the market or commercial off-the-shelf (COTS) support equipment. This invention is manufactured going from the drawings or figures herein after the dimensions are added where applicable, and dimensions are scaled as a whole or individually based on a preference or on the inside diameter of the pipe that needs plugging, but there are dimensions that have been determined to work for an oil pipe with a 21 inch inside diameter. This invention is intended for a user in the oil industry to have the device and support equipment ready to deploy in case of a well blowout during an oil well completion, testing, or workover. It is conceivable to use this invention for restricting any flow of high pressure liquids that comes from a pipe or tubular that have no way of normally turning off due to a malfunction of a valve or other scenarios, but this problem is solved with a device that not only expands or inflates a bladder to plug and close a pipe or tubular, but also it will need help provided indirectly by the device itself to lower the pressure coming from the well stream pipe by indirectly outputting a stream of oil or liquids like it does from the center of the bullet plug 10 that is set at a pressure that is higher than what it is fighting in the well stream pipe or an out of control liquid from a pipe or tubular. Being able to independently expand or reduce the size of the bladder while fighting the gushing well stream allows the device to more easily penetrate the pressure that it is being presented. The following shows more on how everything with the invention works.

Figure 9:
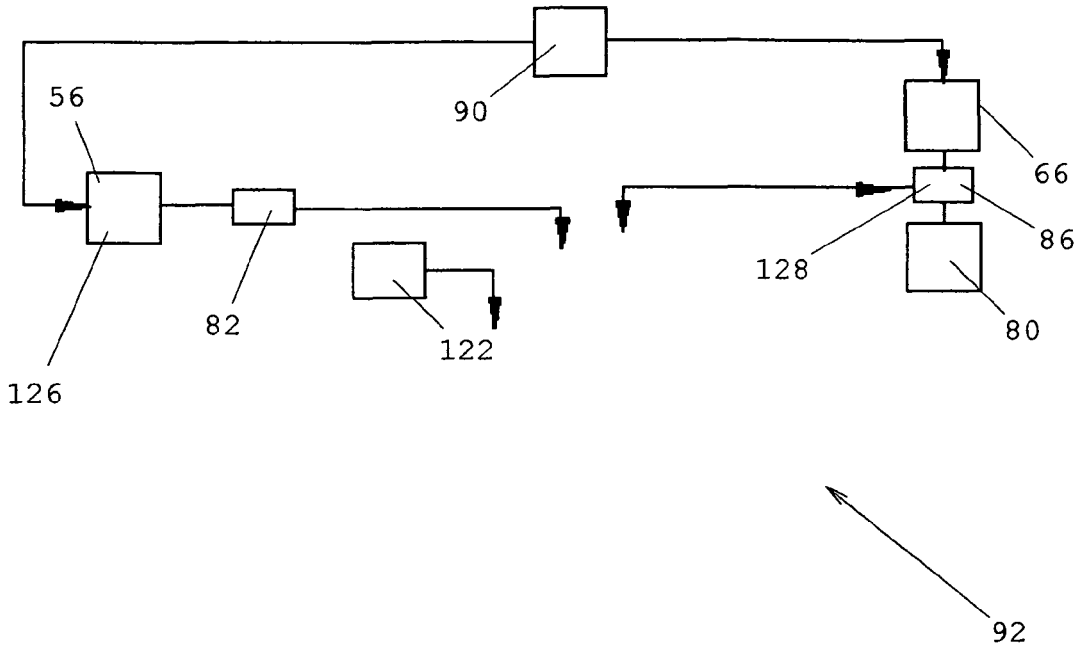
FIG. 9 is a perspective view of a bullet plugging device in shipboard part of closed loop system block diagram in accordance with the invention.

The two main hoses input port hose one 72 and a input output port hose two 74 FIG. 1 are connected to shipboard equipment 92 each having an inline well valve that is near the top of deepwater oil well pipe 124 or riser top 36 after bullet plug 10 has closed or cutoff the bypass 42 by expanding the bladder 22 up against the inner wall of the pipe and then last strut is pinned by pin 38 and input port hose one 72 is still supplying the high pressure oil from shipboard to fight the pressure from the subsea well stream. A input output port hose two 74 with inline well valve four 88 FIG. 1 attached in series, and cement hose 54 FIG. 5 from cement pump 122 FIG. 9 are the other two hoses attached to shipboard equipment 92 shown in FIG. 9.

Figure 3:
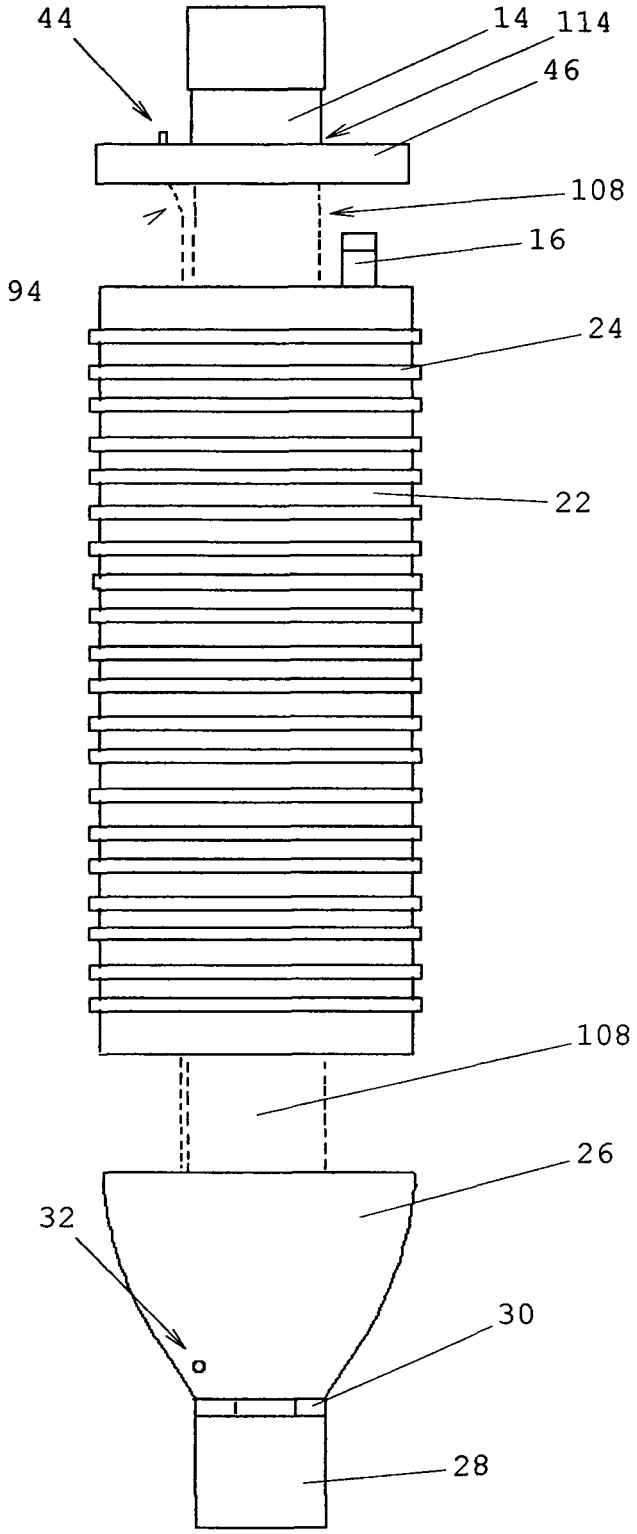
FIG. 3 is a front exploded view of a front exploded view showing internal pipe location in respect of bullet plugging device shown in FIG. 2.
Figure 7:
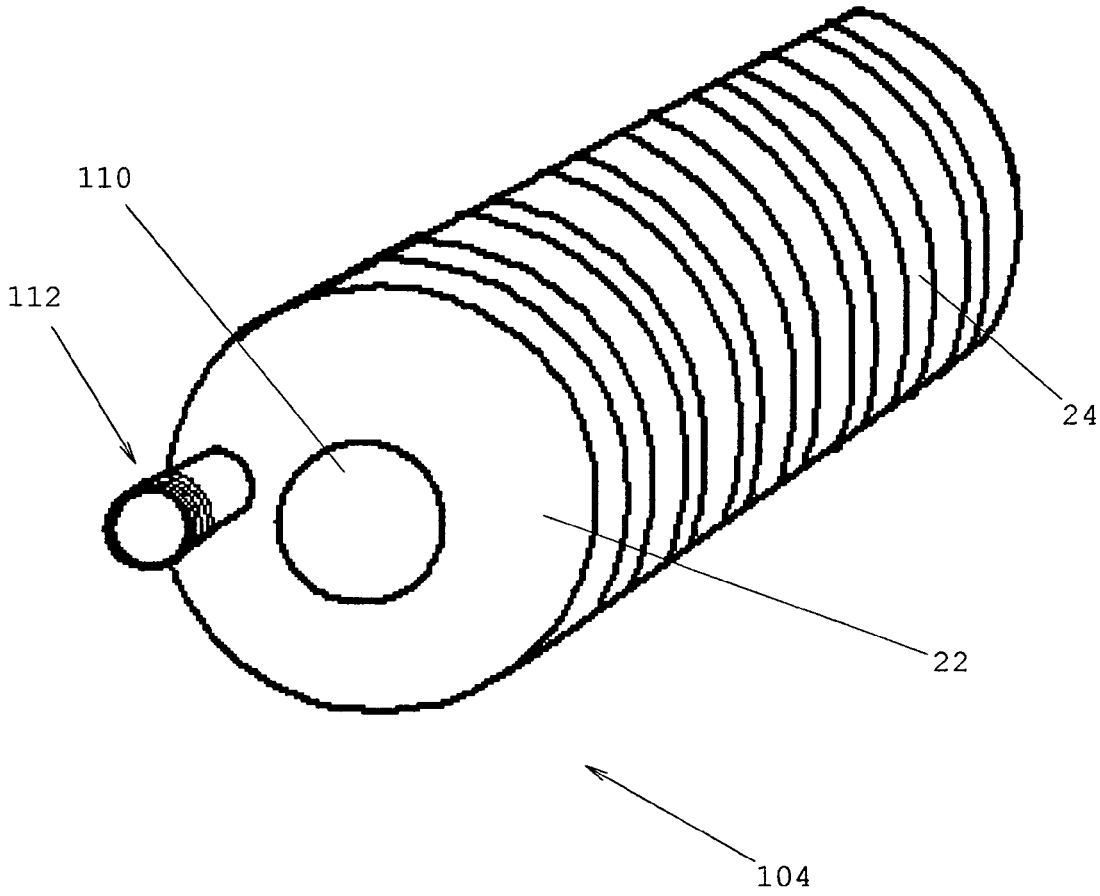
FIG. 7 is a top perspective view of a bladder as shown in FIG. 2 in accordance with the invention.

A shipboard bidirectional valve 86 is switched to a vacuum pump 80 to collapse or shrink the size of the bladder 22 to its minimum size inwardly and up against an input output port pipe 108 FIG. 3 using its bladder hole 110 FIG. 7 that has the input output port pipe 108 going through the center of it that provides or is a conduit for the high pressure oil from the output port and nozzle 28 that comes from the shipboard pump two 56 when turned on and with shipboard valve one 82 and well valve two 84 both open. The nozzle on a output port and nozzle 28 is set by either turning it clockwise or counterclockwise to an optimal high pressure spray pattern that is set to use for fighting a gushing oil well pipe to help gain a stable entry and to finally gain a certain distance down the pipe, and a spray pattern based on the size of the pipe and the pressure from the well stream.

An undersea robot positions the bullet plug 10 at an angle to the side of the gushing oil well pipe oil stream with shipboard pump 56 turned on just before entry into the well and adjusted to a pumping pressure that is estimated to be higher than the pressure coming out of the subsea oil well pipe or a deepwater oil well pipe 124, and the shipboard pump can be adjusted accordingly to pump instrumentation pressure readings. The input port hose one 72 using coupler 18 as hose coupler connected this hose to a input port one hole 14 FIG. 2 or the top threaded end of input output port pipe 108 FIG. 2 of the bullet plug 10. A second hose for deflates bladder 22 FIG. 1 to its smallest size by vacuum and bullet plug 10 is now ready to enter the gushing well pipe. The input output port hose two 74 using coupler 20 as a hose coupler connects this hose to a input output port two 16 FIG. 3 that is intended to protect a bladder stem 112 on a ports containment holder and bladder restraint 46 of the bullet plug 10. Also attached to the side of the input port hose one 72 is a cement hose 54 FIG. 5, a fiber optic cable on connector 44 FIG. 2, and a strut 34 FIG. 5 that is bolted to the ports containment holder and bladder restraint 46 that is used like a metal restraining cap for the top side of the bladder 22 that contains the bladder while it is expanding the ribbed 24 bladder 22 up against the inside of the well stream pipe to prevent having any sizable movement of the bladder up or down or towards the ports containment holder with a nosecone and bladder restraint 26 on the other end when the device is stationary and getting ready to cutoff a oil bypass that is at the moment being used by the gushing well.

Figure 4:
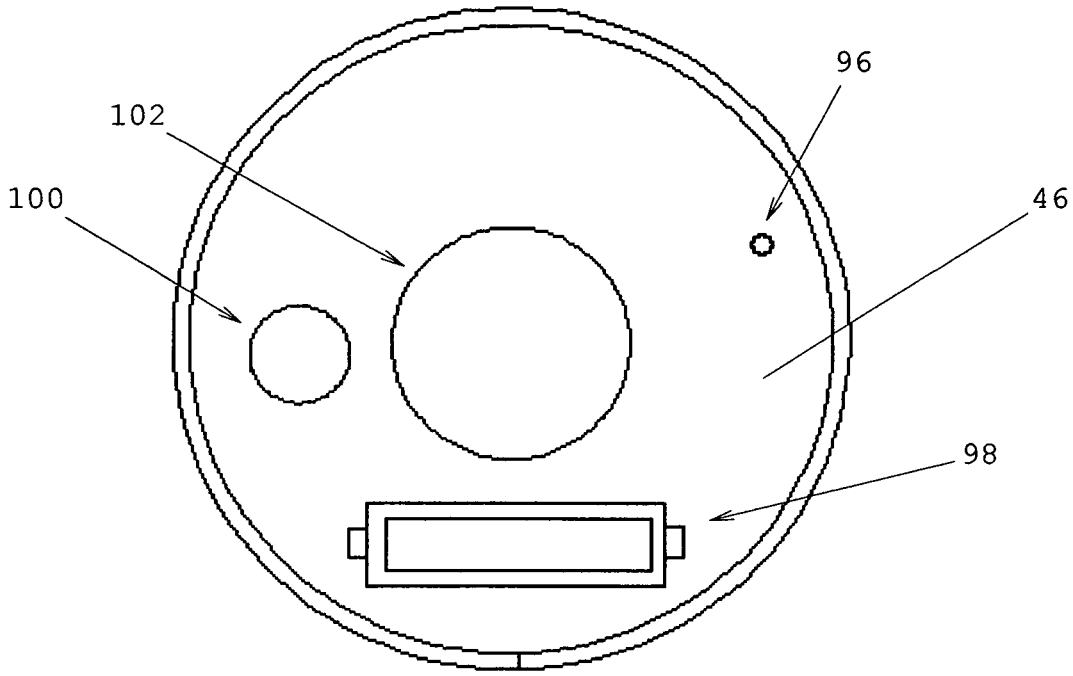
FIG. 4 is a perspective view of a ports containment holder and bladder restraint part in accordance with the invention.

The strut 34 connects to the strut slot and bracket 98 FIG. 4, and the strut mounting bolts 206 secure the first strut to the ports containment holder and bladder restraint 46 at the top of the bullet plug 10 when vertically in the oil well pipe to plug. The strut slot and bracket on the top side of the bullet plug 10 is hinged to allow the strut to move back and forward and may be of some benefit if a well pipe is bent while it is attached to the bullet plug 10. The bullet plug is inserted into the deep-water oil well pipe 124 by the undersea robot, and bullet plug 10 moves down the pipe to the proper or predetermined depth and if the length down the pipe is longer than a strut 34 then another strut will have to be added after pinning the last one with pin 34 to the oil pipe or riser top 36. This allows the undersea robot to add additional struts for safety as the bullet plug 10 proceeds down the gushing oil well. The resistance that the bullet plug is getting from the gushing oil well has been reduced by oil or liquid that is coming out of the output port and nozzle 28 from the shipboard pump two 56 and with the contoured design of the nosecone and bladder restraint 26, and all of this helps in making it much easier to control the robot is holding. Once the last strut 34 is pinned by pin 38 then it is time for the bladder 22 of the bullet plug 10 to be expanded and then finalize the permanent plugging of the well.

Figure 5:
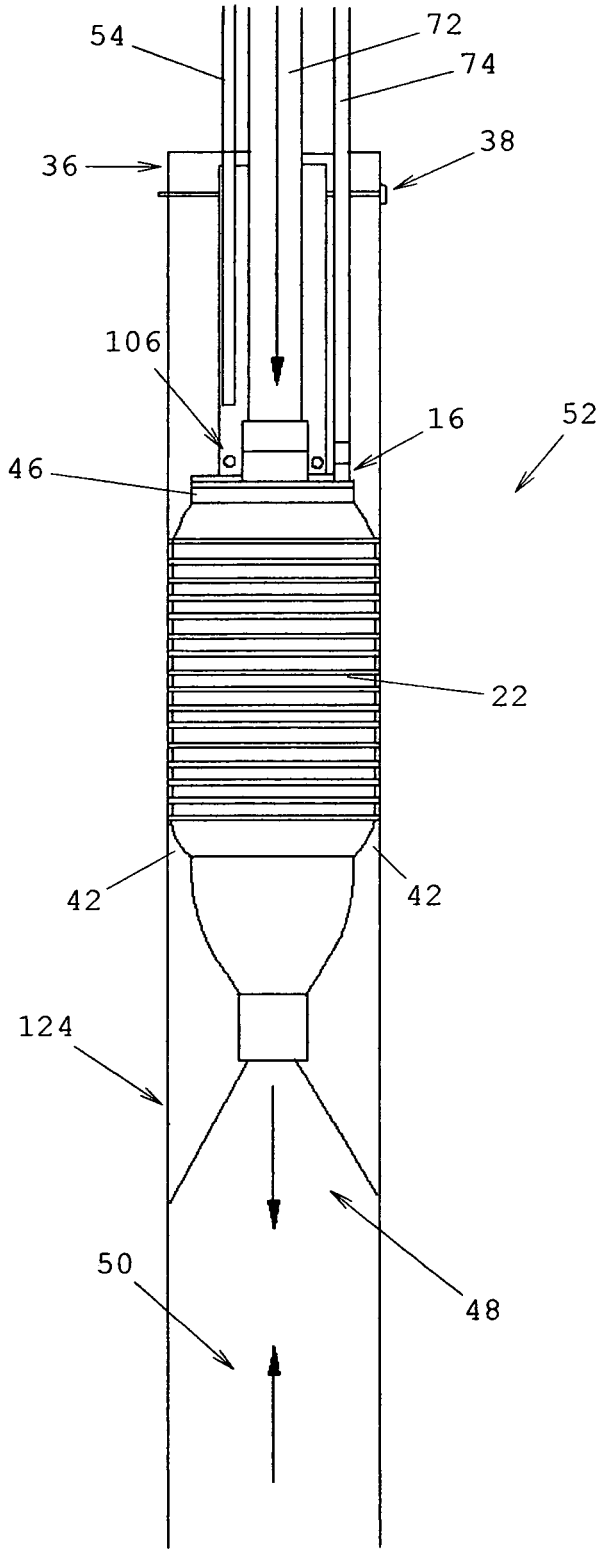
FIG. 5 is a perspective view of a bullet plugging device in the expanded state of FIG. 1 in accordance with the invention.

The plugger expanded 52 FIG. 5 shows a bladder 22 of bullet plug 10 in the expanded state after being switched from a shipboard vacuum pump 80 FIG. 1 that shrinks the bladder 22 to the most reduced size state, to a pump two 66 that expands the a bladder 22 to its maximum size state. While the bladder 22 is expanding from the recycled oil from a ship-board oil tank 90 FIG. 9 by a shipboard pump one 66 that starts reducing the well stream oil bypass 42 then finally the bullet plug totally cuts off this oil bypass 42 while the output port and nozzle 28 continues to output and push with high pressure recycled oil or other liquids using the shipboard pump two 56 FIG. 1 that is spraying oil through the nozzle and against the gushing well to fight the pressure and prevent the now stationary bullet plug 10 that has reached the desired distance in the pipe from being pushed up or out of the well pipe by the gushing oil well while the high pressure oil from shipboard pump two 56 is continuing to assist the expanded bullet plug 10 by lowing the pressure of the well stream or oil pipe gusher. The bladder 22 is now up against the inside wall of the well pipe or tubular, and pressure for this being maintained and pumped with a lower pressure oil or liquids around 300 pounds per square inch (PSI), but giving it the maximum allowed pressure for the steel-belted ribbed 24 rubber bladder 22 that has to maintain enough pressure for a period of time up against the inside of the pipe while the high pressure ship-board oil 48 or other liquids output from the output port and nozzle 28 and continues to lower the pressure from the gushing oil well that is trying to push harder against the bottom of the expanded bullet plug 10 now that there is no well stream bypass 42. After a short period of time, the cement mix slurry from cement pump 22 is pumped through the cement hose 54 FIG. 5. While maintaining the required pressure of 300 pounds per square inch (PSI) or whatever the maximum pressure the bladder can take from shipboard pump one 66 into the bladder 22 that is now stationary and 360 degrees up against the inner wall of the deepwater oil well pipe 124, A higher pressure from shipboard pump two 56 is maintained than what the gushing well stream has with the cement mix slurry being poured on top of the bullet plug 10 by cement pump 122, and to begin filling up the pipe with cement slurry that will eventually go around the hoses, fiber optic cable and any struts to just above pin 35 of the last or only strut or at the top of the oil well pipe from a cement hose 54 that is attached to the input output port hose two 74 or input port hose one 72 and the end of the cement hose 54 is located near the top of the bullet plug 10 open and not connected to anything. Once it is determined that the cement has cured after waiting on cement (WOC) then it is time to turn off the shipboard pump two 56 and let the pressure from the oil well close the check valve 116.

Figure 10:
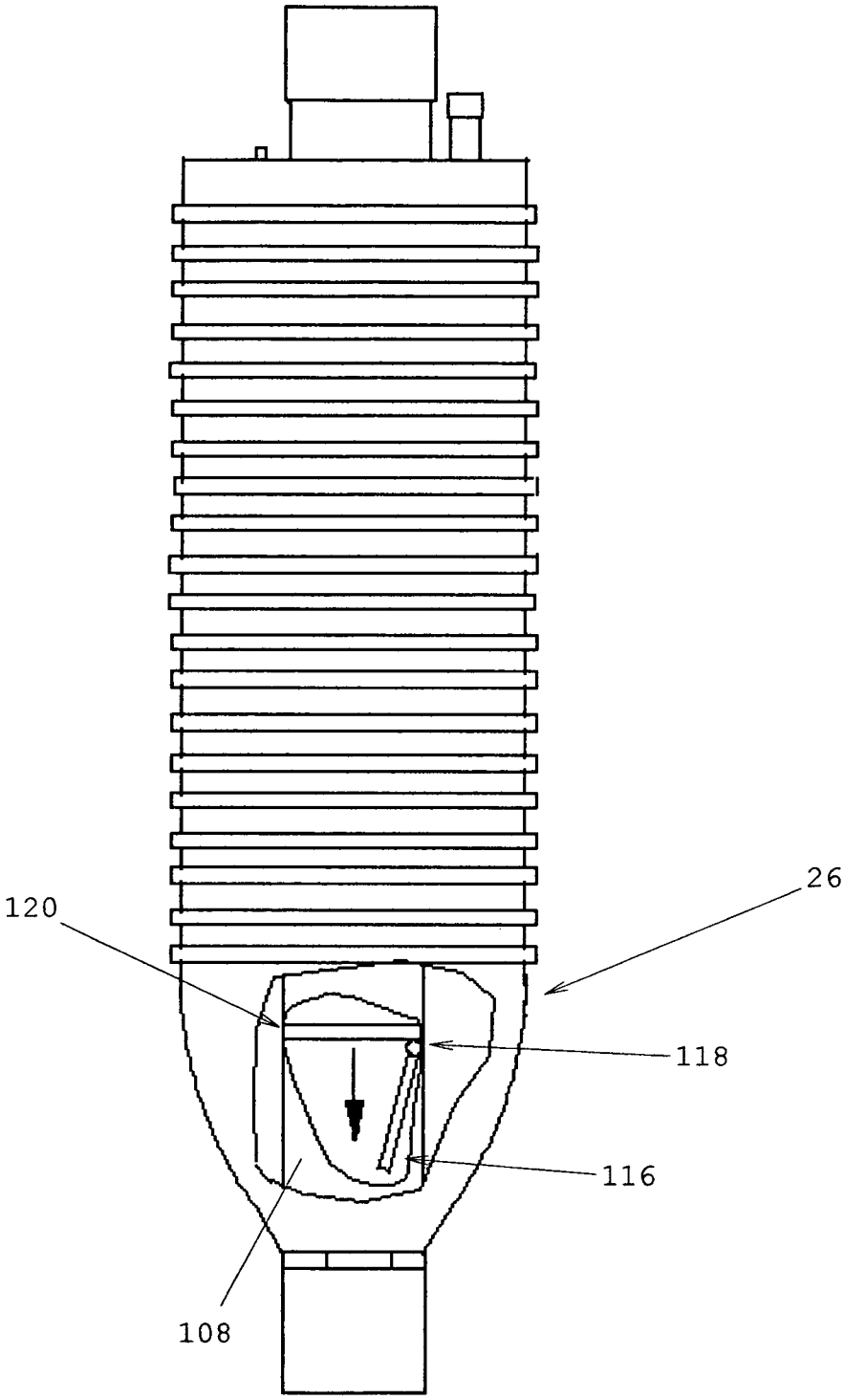
FIG. 10 is a front sectional view of an internal pipe location in respect of bullet plugging device shown in FIG. 3.

A Check valve 116 FIG. 10 is normally closed under spring tension and opens under high pressure from shipboard pump two 56 and this flap or check valve 116 is intended to close shut against the metallic stopper 120 from the high pressure well stream coming in the opposite direction of shipboard pumped oil stream when shipboard pump two 56 is turned off the only pressure left is hydrostatic pressure from the residual oil in the input port hose one 72 that can be pumped out shipboard, but this should not prevent the check valve 116 from closing, but it may be fixed with a wireline if there is any problem or it gets stuck due to a malfunction. The cement has cured then the well is plugged. The check valve 116 that is closed will not allow any gushing oil from the well stream to come into the input port hose one 72 after the shipboard pump two 56 is turned off and then shipboard valve one 82 and well valve two 84 are closed.

The other important shipboard equipment connection by hose is an input output port hose two 74 that supplies the bladder 22 of the bullet plug 10 a vacuum for deflating or shrinking it to its smallest size and with its contoured nose-one design during movement against the gushing oil or liquid in the pipe or inflating it to its largest size with oil or liquid to make it stationary and it grips the inside of the pipe and stop movement while spray pattern of the output port and nozzle 28 located at the bottom and center of bullet plug 10 continues to fight the deep well oil 50 or well stream prior to letting the cement flow at the top of the bullet plug 10. An inline well valve four 88 FIG. 1 is connected to the input output port hose two 74 that is used in case there is a problem at the subsea or land oil well or at the end of the plugging operation. The cement is cured then the input output port hose two 74 connected to well valve four 88 is closed by the undersea robot along with the check valve 116 that closed automatically from the pressure of the gushing oil well. The input port hose one 72, and the input output port hose two 74 are removed from the inline valves if no longer required with well valves shut.

Initially, and before entry into a well pipe, a shipboard valve 86 FIG. 1 is switched to a shipboard vacuum pump 80 that is pumping to reduce or shrink the a bladder 22 of the bullet plug 10 to its minimum outside diameter then the bullet plug 10 is lowered to a desired or estimated distance into the pipe preferably after any damaged area and deep enough to be an effective plug as the high pressure oil being pumped from a shipboard pump two 56 through output port and nozzle 28 continues to fight the gushing oil from the well, then it is time to expand bladder 22 with oil or other liquids to an acceptable pounds per square inch (PSI) that allows the bladder 22 bullet plug 10 to hold as tight as possible up against the inside of wellbore pipe at 360 degrees at a maximum PSI specification allowed as input port hose one 72 continues to supply the bullet plug 10 high pressure recycled oil or other liquids to fight a well stream blowout, and this is done by switching the shipboard bidirectional valve 86 to the low pressure oil from shipboard pump one 66 FIGS. 1 and 9 that uses recycled oil from shipboard oil tank 90.

A Shipboard valve one 82 switches high pressure shipboard oil from a shipboard pump two 56 to the bullet plug 10 through the input port hose one 72 if well valve two 84 is open or turned on. Well valve 84 has the continuation of input port hose one 72 connected and the other end of input port hose one 72 is connected to an input port one 14 of a ports containment holder and bladder restraint 46 FIGS. 3 and 4 of the bullet plug 10. Hoses at from well valves connect to coupler one 18 and coupler two 20 on the bullet plug 10.

The bullet plug 10 FIG. 1 has an input port hose one 72 and an input output hose two 74 connected to it from shipboard, and it also has a cement hose 54 FIG. 5 for dispensing cement when the time comes from cement pump 122 FIG. 9 and it is not physically connected to the bullet plug 10 FIG. 1, but it is attached to one of the hoses that go with the bullet plug 10 from shipboard equipment 92 FIG. 9 into the oil well along with a number of strut 34 FIGS. 1 and 5 sections that go with the hoses or installed by undersea robot. The number of struts is determined by how deep the bullet plug 10 will go into the oil well pipe and extra struts 34 sections can be added by undersea robot.

The shipboard bidirectional valve 86 FIGS. 1 and 9 is initially switched by procedure to the shipboard vacuum pump 80 FIGS. 1 and 9 to collapse and evacuate the bladder 22 shown in FIG. 1. A bypass 42 is allowing oil to pass through to the top of the deepwater oil well pipe 124 on FIG. 1. Then with the high pressure shipboard oil 48 FIGS. 1 and 5, shipboard pump two 56 FIGS. 1 and 9 pumping oil through the bullet plug 10 FIGS. 1 and 5 and out of the output port and nozzle 28 FIGS. 1 and 5 next to the nosecone and bladder restraint 26 FIGS. 1 and 2 in order to decrease the resistance of the gushing oil well or cut through it like a knife or in this case an oil knife until it has reached the proper depth in the deepwater oil well pipe 124 FIGS. 1 and 5.

Strut 34 FIGS. 1 and 5 sections are added depending on how far to go down the deepwater oil well pipe 124. The first strut 34 is bolted onto the strut slot and bracket 98 located on the ports containment holder and bladder restraint 46 FIG. 4, and the last strut 34 has a pin 38 inserted at the riser top 36 FIG. 1 by the undersea robot. If the strut 34 section is 20 feet long and it is determined that the bullet plug 10 must go to at least 200 feet down the oil well pipe then 10 sections are needed then the bidirectional valve 86 FIGS. 1 and 9 is then switched to shipboard pump one 66 FIGS. 1 and 9 in order to inflate the bullet plug 10 with oil into bladder 22 FIG. 7 and FIG. 8. The bladder 22 expands 360 degrees and cuts off the bypass 42 as shown in FIG. 5. The oil output pumped against the oil well from the nozzle reduces the pressure, and the each rib 24 of the bladder 22 FIG. 7 is pushing up against the inside diameter of the oil well pipe cutting off the flow from the gushing oil well and allowing the cement pouring operation to begin while maintaining a proper oil pressure in the bladder 22 and pumping high pressure oil into the well from the nozzle 28 FIG. 5.

Shipboard and inline valves near the oil well riser 40 FIGS. 1 and 5 are used in the procedure or sequence used to finally plug the deep oil well pipe with the bullet plug 10 FIGS. 1 and 9, and finally turn off the flow of oil at well valve two 84 FIG. 1 and cut the hose when the cement dries, and also the valves may be needed in case something malfunctions. A cement pump 122 in FIG. 9 has a third hose that goes near the top of bullet plug 10 into riser 40 for filling up the oil pipe with cement after bullet plug 10 seals the deepwater oil well pipe 124 FIGS. 1 and 5.

Figure 2:
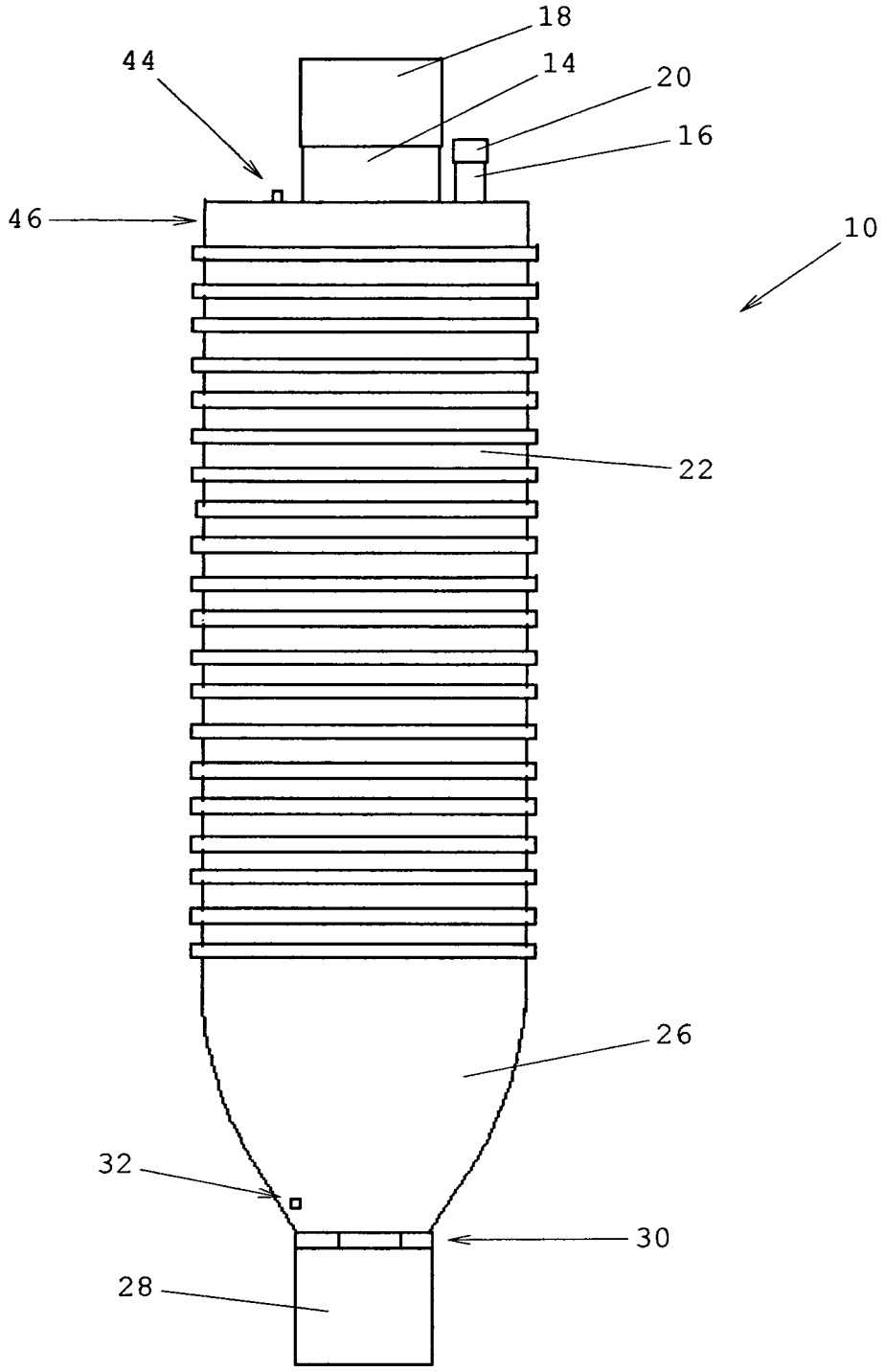
FIG. 2 is a perspective view of a bullet plugging device of FIG. 1.

FIG. 2 is a perspective view of the bullet plug 10 FIGS. 1, 2, 3, 5, and 10 in accordance with invention. The ports containment holder and bladder restraint 46 FIGS. 1, 2, 3, 4, and 5 has an input output port two hole 100 FIG. 4 for bladder stem 112 FIGS. 7 and 8 and an input port one hole 102 FIG. 4 for the input output port pipe 108 FIGS. 3 and 10. The input output port pipe 108 FIGS. 3 and 10 goes through the center of the bladder 22 FIGS. 7 and 8 in the bladder hole 110 FIGS. 7 and 8 exposing the outside screw threads on both ends that are sticking out on both ends of the bladder 22 during assembly. The inside threaded hole of the input port one hole 102 FIG. 4 of the ports containment holder and bladder restraint 46 FIG. 4 is screwed onto the outside threads of the input output port pipe 108 FIG. 3 on one end. Nut number two 114 FIG. 3 screws onto input output port pipe 108 then is spot-welded. The ports containment holder and bladder restraint 46 is screwed on first to the input output port pipe 108 that has inside screw threads in the hole of the input port one hole 102 FIG. 4. Another nut number three 134 FIG. 2 screws on the bladder stem 112 or input output port two 16 FIG. 2 that has outside threads. There is a sensor connector mounting hole 96 FIG. 4 for a panel mount waterproof connector 44 shown mounted on FIGS. 2 and 3, and an opening 32 for a sensor on FIG. 2, and it is connected by cable 94 FIG. 3. The strut slot and bracket 98 FIG. 4 accepts the struts that are in sections that assist the bullet plug 10 with insertion and descending into deep oil well that is being pushed into the oil well by the robot as the input port hose one 72 FIG. 1 provides high pressure oil from the shipboard pump two 56 FIG. 1 that goes through the input output port pipe 108 FIG. 3 then the output port and nozzle 28 FIGS. 1, 2, and 3 to fight the incoming oil from the deepwater oil well. A number of struts needs to be determined for the approximate depth or to assist the bullet plug 10 in getting beyond the bad part of the deep oil well. Strut 34 FIGS. 1 and 5 metallic bars are secured with the strut mounting bolts 106 FIG. 5.

Figure 6:
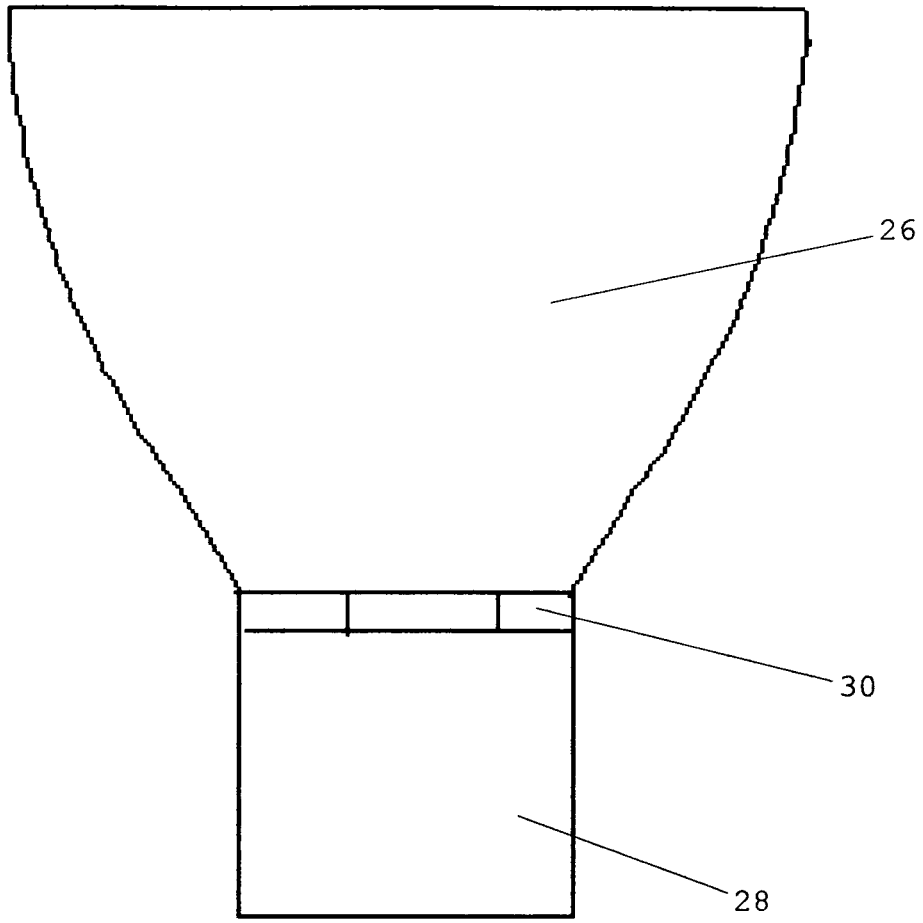
FIG. 6 is a perspective view of a nosecone and bladder restraint and nozzle part shown in FIG. 2 in accordance with the invention.

The nosecone and bladder restraint 26 FIG. 2 and FIG. 6 is screwed on to the threaded input output port pipe 108 until is hits a stopper or the excess metal on the outside of the input output port pipe 108 or pipe. The nut number one 30 is screwed onto the input output port pipe 108 and spot-welded. The output port and nozzle 28 screws on to the input output port pipe 108. Spray pattern of output port and nozzle 28 is preset.

Figure 8:
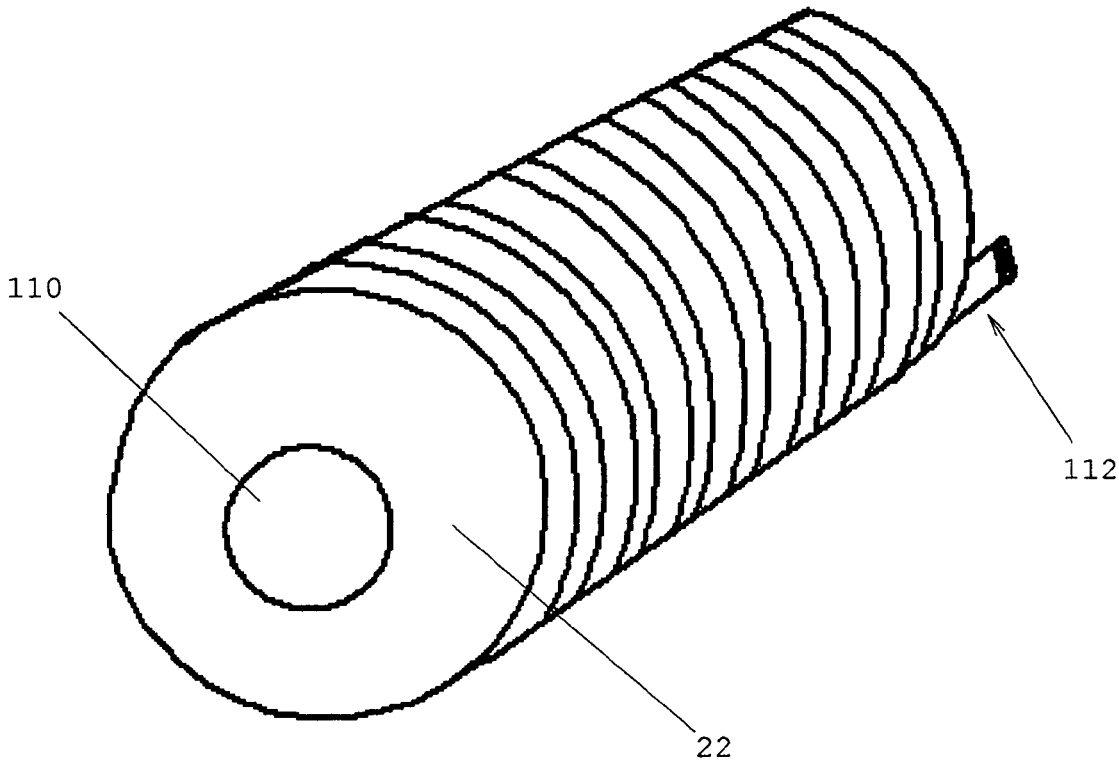
FIG. 8 is a bottom perspective view of a bladder as shown in FIG. 2 in accordance with the invention.

All aforementioned parts, except for shipboard equipment 92 FIG. 9 and equipment already existing at the oil well riser 40 FIGS. 1 and 5, are parts that are manufactured by machine shop or someone skilled in the art. The bladder 22 FIG. 7 and FIG. 8 is more specialized and would be done by a company that is skilled in the art of making aircraft tires that have a much higher pounds per square inch (PSI) than the ones used on automobiles. Typically, electronic Computer-aided drawings (CAD) of the bullet plug 10 pieces or parts like some of the figures after adding dimensions as US and metric of the bullet plug 10 are submitted to modern machine shops that have Computer-aided manufacturing (CAM) to automate as much as possible the production of bullet plug 10 parts FIG.

3. Drawings for manufacturing will have the dimensions to accurately machine the parts, and some dimensions can be changed individually to suit the application or pipe.

Except for the spot welding and steel-belted bladder 22 there is no other equipment necessary to build and assemble the bullet plug 10. Aforementioned shipboard oil 48 FIG. 1, shipboard pump one 66 FIG. 1, low pressure oil pump, shipboard vacuum pump 80 FIG. 1, high pressure shipboard pump two 56 FIG. 1, shipboard cement pump 122 for injection of cement with cement hose 54 FIG. 5 and input port hose one 72 FIGS. 1 and 5 and input output port hose two 74 FIGS. 1 and 5 is available. The bullet plug 10 assembled is tested by inflating bladder 22 with air to maximum pressure when plugger expanded 52 FIG. 5 inside and outside of a pipe. The size of the bullet plug 10 is proportional to the size of the oil well pipe inside diameter. Approximately 5 feet longer or shorter in length for a 21 inch pipe and an outside diameter of approximately 18 inches smaller or bigger when deflated.

FIG. 10 is the bullet plug 10 as in FIG. 2 showing, but FIG. 10 is showing a cutaway view of the nosecone and bladder restraint 26 and the internal input output port pipe 108 that is threaded on both ends and is used for containing the bladder like a tire rim on an automobile and also have a coupler one 18 and a hose connection to pump 56 for high pressure oil that is fighting the gushing well before and after the bladder 22 in expanded or inflated with oil. The last or only strut 34 is pinned and cement is being poured on top side of the bullet plug 10 after the bladder 22 is inflated enough with oil to be stable and stationary and does not move then a sufficient quantity maybe filled with cement slurry all the way up the pipe just before the strut pin on the last strut then there will be waiting on cement (WOC). After a period of time the cement is cured and there is no more need to maintain pressure in the bladder 22 and the shipboard pump one 66 is turned off and the well valve four 88 is closed stops supplying pressure of oil to the bladder 22. The check valve 116 that is shown inside input output port pipe 108 FIG. 10 that has a spring loaded flap hinge 118 and a metal stopper 120 that is welded that seals the flow of oil when the oil knife or stream from the output port and nozzle 28 stops by closing either shipboard valve one 82 or well valve two 84 FIGS. 1 and 9, and this would cause the oil under pressure from the deepwater oil well to overcome the hydrostatic pressure of any oil remaining in the input port hose one 72 then a flap or check valve 116 slams shut against the metallic stopper 120 FIG. 10 that is welded or machined on the inside of input output port pipe 108. Turning off well valve two 84 FIG. 1 is mainly used for the final step of sealing or plugging the well. Hoses are cut after the cement dries and with the well plugged, the well valves are turned off.

The bullet plug invention is a low cost device that is easy to assemble and deploy that is used to plug an out-of-control subsea or land oil well that starts gushing during well completion, well testing, or well workover. The bullet plug device with two main ports for hoses, has a steel-belted bladder 22 with a hole in the center or void space for a threaded pipe that goes through it. The bladder of the bullet plug is deflated to allow the least resistance possible in the well pipe by reducing the outside dimensions close to the diameter of the nosecone and bladder restraint 26 by using an external vacuum upon its entry into the well stream with shipboard vacuum pump 80 instrumentation showing it completely deflated before entry into the pipe then proceeding with insertion or movement to a certain distance into a well pipe by robot holding the hoses or strut and pushing it past any damage in the pipe and enough room for cementing from a hose that is near the top of the bullet plug and pinning the struts as a backup to holding the bullet plug stationary, in addition an expanded bladder and oil stream provided externally to the bullet plug for fighting the oil well gusher to reduce the high pressure that would make plugging the well impossible without it.

The device is designed to simultaneously fight an oil gusher through the center of the bullet plug 10 and bladder 22 with high pressure oil or other liquids while allowing the bullet plug to remain stationary not only to pin a metal strut, but also while the lower pressure shipboard pump is inflating the bladder that starts reducing the oil bypass around the plug is a critical time for making sure that the gusher is being pushed down by the oil being pumped externally through the bullet plug nozzle at the same or higher pressure to stop or push the gushing oil or gas downward enough while the cement that is being poured on the top of the bullet plug is curing. The bullet plug expanded up against as tight as possible alone cannot be considered a guarantee that the pressure will from the gushing oil or gas well will overcome it and push it out of the well possible causing damage the well and other equipment without having the stream of oil from an external or shipboard pump 56 simultaneously fighting the gushing oil well then being able to permanently seal it off the broken well with cement that is cured and with addition help from the check valve and struts and then remove all external support equipment except the well valves.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A high pressure oil pipe bullet plug for a high pressure oil pipe hole plugging apparatus that cuts through gushing oil and inflates with oil to facilitate a permanent plugging of an oil well pipe, comprising:

a mechanical connection with a high pressure shipboard oil hose through a coupler to give an output port and nozzle a high pressure oil output to fight and lower the pressure of incoming oil gushing from well;

a bladder in the static or reduced size state by a shipboard vacuum pump for inserting a plugging device into oil well riser, a bidirectional valve for switching to expand a bladder with the oil or liquids at a safe pounds per square inch (psi) to plug or shutoff the well from the gushing oil while oil stream from an output port and nozzle of the bullet plug continuing to fight the flow from the well;

a mechanical coupler connection with a low pressure shipboard vacuum and oil hose for the bladder in the static state or reduced size by the shipboard vacuum pump during its insertion and descending of the plugging device into oil well riser then providing the same connection with the bidirectional valve for expansion of the bladder with oil at a safe amount of pounds per square inch (psi) to plug or shutoff the well from gushing while oil stream from the output port and nozzle continues fighting a flow from the well;

a secure connection with the high pressure shipboard oil hose;

a secure connection with the low pressure shipboard oil and vacuum pump;

an oil well bypass with a bullet plug deflated and blocking or shutting off gushing oil well with bullet plug inflated tight by oil to the inside diameter of oil well pipe;

a restraining bladder on one end and assisting with the maximum penetration an inside oil well pipe on other end with shape of nosecone and has a center opening for output port and nozzle attachment;

a output port and settable spray pattern for shipboard oil that fights incoming gushing oil from well;

a oil well bypass with the bladder deflated with the bladder inflated tight by oil to the inside diameter of oil well pipe shutting off gushing oil well bypass;

a nosecone and bladder restraint secured from screw threads on output port pipe and a nut;

a strut used by undersea robot for bullet-shaped plugging device installation into oil well and a pin with the bullet plug at the proper depth;

a strut secured to riser pipe;

an oil well pressure bypass around bullet shaped plugging device;

a connection for a sensor on gushing oil well end of bullet-shaped plugging device;

a hole for input port and vacuum pump port, and containing and securing a bladder at one end not to expand beyond a ports containment holder and bladder restraint thus concentrating the expansion to up against the inside of the oil well pipe as tight as possible;

shipboard oil to fight the oil pressure from a deep water oil well;

a cement mixture dispensed on top of bullet-shaped plugger to cure in smaller batches for maximum hardening while bullet plugger is expanded and blocking the oil from the gushing oil well;

a high pressure shipboard oil pump that pumps recycled oil from the well back to the well based on affect of pressure from the oil well to instrumentation of pump two;

a pumping of low pressure recycled oil into bladder to expand and plug gushing oil well maintaining oil pressure based on pump one instrumentation and with a bidirectional valve switched to pump one and not vacuum pump;

a same oil from the well and oil pressure to the output port and nozzle of bullet-shaped plugging device to fight incoming oil from oil well;

a vacuum from shipboard vacuum pump or recycled oil from shipboard oil pump to the bladder;

a bladder is at its minimum size possible for insertion into oil well pipe;

a valve turn on and cutoff of high pressure recycled oil from a shipboard pump two, rigidly connected for providing high pressure shipboard oil pump that pumps recycled oil from the well back to the well based on affect of pressure from the oil well to instrumentation of pump two;

a valve turn on and turn off near a oil well riser for high pressure recycled oil from shipboard pump two, rigidly connected to said means for providing turn on and cutoff of high pressure recycled oil from shipboard pump two, and rigidly connected to said means for providing holes for input ports and vacuum pump port, and containing and securing a bladder at one end not to expand beyond the ports containment holder and bladder restraint thus concentrating the expansion to the sides up against the inside of the oil well pipe as tight as possible;

a bidirectional switching from shipboard low pressure recycled oil to the bladder of the bullet plug or a vacuum to the bladder of the bullet plug, rigidly connected to the bladder to allow it to shrink to a minimum size possible for insertion into oil well pipe, and rigidly connected to a pumping of low pressure recycled oil into the bladder and plug gushing oil well maintaining oil pressure based on pump one instrumentation and with a bidirectional valve switched to pump one and not vacuum pump;

a valve turn on and turn off near oil well riser for low pressure recycled oil from shipboard pump one or from shipboard vacuum pump, rigidly connected to bladder to shrink it to minimum size possible for insertion into oil well pipe, and rigidly connected to provide holes for input port and vacuum pump port, and containing and securing bladder at one end not to expand beyond the ports containment holder and bladder restraint thus concentrating the expansion to the sides up against the inside of the oil well pipe as tight as possible;

recycled oil from well to the bullet plugging device and to the high pressure input port of the bullet plugging device for fighting the gushing oil from the well, rigidly connected to said means for pumping of low pressure recycled oil into bladder to plug gushing oil well maintaining oil pressure based on pump one instrumentation and with bidirectional valve switched to pump one and not vacuum pump, and rigidly connected to said means for providing high pressure shipboard oil pump that pumps recycled oil from the well back to the well based on affect of pressure from the oil well to the instrumentation of pump two;

a strut to be mounted to ports containment holder and bladder restraint part;

an opening for high pressure oil to fight oil gusher and preventing the bladder from closing off center hole of bullet plugging device, rigidly connected for providing holes for input port and vacuum pump port, and containing and securing bladder at one end not to expand beyond the ports containment holder and bladder restraint thus concentrating the expansion to the sides up against the inside of the oil well pipe as tight as possible, and rigidly connected for providing oil well bypass with bladder deflated and blocking or shutting off gushing oil well with bladder inflated tight by oil to the inside diameter of oil well pipe;

an input output port pipe goes through center of bullet-shaped plugger;

a shipboard low pressure oil or vacuum pump from input output hose two;

a sealing of the oil well and supplemental to valve two near the top of the riser; and a cement mixture pumped into plugged oil well pipe in portions for maximum hardening, rigidly connected to said means for providing holes for input ports and vacuum pump port, and containing and securing bladder at one end not to expand beyond the ports containment holder and bladder restraint thus concentrating the expansion to the sides up against the inside of the oil well pipe as tight as possible.

2. The high pressure oil pipe bullet plug in accordance with claim 1, further comprising:

a mechanical connection with the high pressure shipboard oil hose through a coupler to give a output port and nozzle the high pressure oil output to fight and lower the pressure of incoming oil gushing from the well a bladder in the static or reduced size state by a shipboard vacuum pump for inserting or descending a plugging device into oil well riser then providing the same connection for expanding a bladder with oil at a safe amount of pounds per square inch (psi) to plug or shutoff a well from gushing oil while an oil stream from a output port and nozzle of a bullet plug continuing to fight a flow from the well comprises an input port one, being inserted into center of bladder and pipe-shaped and partially threaded for nut and having high pressure oil hose connected and a circular opening in center and the outside diameter almost of the inside diameter of a center hole of the bladder and a nut to hold metallic ports containment holder and bladder restraint part.

3. The high pressure oil pipe bullet plug in accordance with claim 1, further comprising:

a mechanical connection with a low pressure shipboard vacuum and a oil hose for a bladder in the static state or reduced size by a shipboard vacuum pump for its insertion and descending of a plugging device into oil well riser then providing the same connection for expansion of the bladder with oil at a safe amount of pounds per square inch (psi) to plug or shutoff the well from gushing while oil stream from an output port and nozzle continues fighting a flow from the well comprises an input output port two, being flexible and a bidirectional port and having connection to apply a vacuum or pump oil or recycled oil from well into the bladder.

4. The high pressure oil pipe bullet plug in accordance with claim 1, further comprising:

an oil well bypass with a bullet plug deflated and blocking or shutting off gushing oil well with bullet plug inflated tight by oil to an inside diameter of oil well pipe comprises a bladder, being externally and concentrically ribbed and able to sustain high pressure and inflated by shipboard oil and hollow and donut-shaped and flexible and elongated and contained and secured by containment holder and a bladder restraint and having steel-belted multi-ply rubber for strength and gripping power with the bladder expanded and concentric rubber ribs and no buoyancy when evacuated by a vacuum and no buoyancy with bladder pressurized or filled with oil and to a maximum size for particular oil pipe and different sizes according to pipe size and different strengths and stem for the vacuum output and a oil input and sufficient space for gushing oil bypass while inserting and descending the bullet plug into oil well pipe.

5. The high pressure oil pipe bullet plug in accordance with claim 1, further comprising:

a restraining bladder on one end and assisting with the maximum penetration inside oil well pipe with shape and has a center opening for an output port and nozzle attachment comprises a nosecone and bladder restraint, being contoured bullet-shaped for penetration into oil gusher and metallic and secured by a nut and filled with cement for ballast and having strength to withstand opposing external high pressure from oil well and mounting holes inside for an electronic assembly and an opening for pressure sensor and the output port and nozzle in center.

6. The high pressure oil pipe bullet plug in accordance with claim 1, further comprising:

an output port and a settable spray pattern for shipboard oil that fights incoming gushing oil from well comprises an output port and nozzle, being secured by a nut and a spot weld and having threads on a pipe to screw on nosecone and a bladder restraint and inside threads in nozzle and same threads on output port to fasten nozzle and nozzle presetable.

7. The high pressure oil pipe bullet plug in accordance with claim 1, further comprising:

a securing nosecone and bladder restraint from screw threads on an output port pipe comprises a nut number one, being threaded and having nosecone and bladder restraint secured.

8. The high pressure oil pipe bullet plug in accordance with claim 1, further comprising:

struts as sections that assists a bullet-shaped plugging device to install and descend into oil well and pinned at the proper depth comprises a strut, being metallic and hinged at a ports containment and attachable to each other and having in sections.

9. The high pressure oil pipe bullet plug in accordance with claim 1, further comprising:

a strut to riser pipe comprises a pin, being metallic and treaded and having a bolt head and threads for a nut to secure.

10. The high pressure oil pipe bullet plug in accordance with claim 1, further comprising:

oil well oil and a oil pressure bypass around a bullet-shaped plugging device comprises a bypass, being shutoff with the bullet-shaped plugging device is expanded with oil and then there is no oil bypass for oil of gushing oil well.

11. The high pressure oil pipe bullet plug in accordance with claim 1, further comprising:

a connection for sensor on gushing oil well end of bullet-shaped plugging device comprises a connector, being copper or fiber optic.

12. The high pressure oil pipe bullet plug in accordance with claim 1, further comprising:

holes for a input port and a vacuum pump port, and containing and securing a bladder at one end not to expand beyond a ports containment holder and bladder restraint thus concentrating the expansion to the sides up against the inside of the oil well pipe as tight as possible comprises a ports containment holder and bladder restraint, being flanged to mate and hold bladder and fastened by large nuts, threads, and spot welds and having a hole for center input port and a hole for vacuum and input oil port and military standard or fiber optic waterproof connector and contained and secured bladder at one end and hinged bracket and slot for strut connection.

13. The high pressure oil pipe bullet plug in accordance with claim 1, further comprising:

a shipboard oil to fight the oil and oil pressure from a deep water oil well comprises a shipboard oil tank and a pump being set and controlled by shipboard pressure readings and having recycled oil from gushing well.

14. The high pressure oil pipe bullet plug in accordance with claim 1, further comprising:

a cement mixture is dispensed on top of bullet-shaped plugger to cure in smaller batches for maximum hardening while a bullet plugger is expanded and blocking the oil from the gushing oil well comprises a cement hose, being from shipboard and ready after bullet-shaped plugger stops flow of oil and having special type of cement.

15. The high pressure oil pipe bullet plug in accordance with claim 1, further comprising:

a high pressure shipboard oil pump that pumps recycled oil from the well back to the well based on affect of pressure from the oil well to the instrumentation of pump two comprises a high pressure, pumping recycled oil from a shipboard pump two.

16. The high pressure oil pipe bullet plug in accordance with claim 1, further comprising:

a pump of low pressure recycled oil for a bladder to expand and plug gushing oil well maintaining oil pressure based on pump one instrumentation and a bidirectional valve is switched to pump one and not a vacuum pump comprises a shipboard pump one, being of low pressure and having recycled oil and connection to a bidirectional valve.

17. The high pressure oil pipe bullet plug in accordance with claim 1, further comprising:

the same oil and oil pressure to an output port and nozzle of a bullet-shaped plugging device to fight incoming oil from oil well comprises an input port hose one, being high pressure and flexible and having a connection to a high pressure oil pump two.

18. The high pressure oil pipe bullet plug in accordance with claim 1, further comprising:

a vacuum from a shipboard vacuum pump or recycled oil from a shipboard oil pump to a bladder comprises an input output port hose two, being vacuum or oil hose and flexible and having connection to a shipboard bidirectional valve and high pressure rating.

19. The high pressure oil pipe bullet plug in accordance with claim 1, further comprising:

a bladder to shrunk it to its minimum size possible for insertion into oil well pipe comprises a shipboard vacuum pump that is able to collapse bladder and able to evacuate air and oil and able to remove buoyancy.

20. The high pressure oil pipe bullet plug in accordance with claim 1, further comprising:

a valve turn on and cutoff of high pressure recycled oil from a shipboard pump two comprises a shipboard valve one, being turn off valve for high pressure recycled shipboard oil and turn on valve for high pressure recycled oil.

21. The high pressure oil pipe bullet plug in accordance with claim 1, further comprising:

a valve turn on and turn off near oil well riser for high pressure recycled oil from a shipboard pump two comprises a well valve two near to the well, being a turn off valve for high pressure oil coming from shipboard and a turn on valve for oil coming from shipboard.

22. The high pressure oil pipe bullet plug in accordance with claim 1, further comprising:

a switching from shipboard low pressure recycled oil to a bladder of a bullet plug or a vacuum to the bladder of the bullet plug comprises a shipboard bidirectional valve, being a switch for oil input to the bladder and a switch for vacuum output from the bladder.

23. The high pressure oil pipe bullet plug in accordance with claim 1, further comprising:

a valve turn on and turn off near a oil well riser for low pressure recycled oil from a shipboard pump one or from a shipboard vacuum pump comprises a well valve four, being cut off valve at well for shipboard pump one and cutoff valve at well for shipboard vacuum pump and inline with an input output port hose two.

24. The high pressure oil pipe bullet plug in accordance with claim 1, further comprising:

recycled oil from well to a bullet plugging device and to a high pressure input port of the bullet plugging device for fighting the gushing oil from the well comprises a shipboard oil tank, being shipboard and having recycled oil from well.

25. The high pressure oil pipe bullet plug in accordance with claim 1, further comprising:

a strut to be mounted to a ports containment holder and bladder restraint part comprises a strut mounting bolts, being a fastener to a bullet plug.

26. The high pressure oil pipe bullet plug in accordance with claim 1, further comprising:

an opening for high pressure oil to fight oil gusher and preventing a bladder from closing off center hole of bullet plugging device comprises an input output port pipe, being cylindrical and metallic.

27. The high pressure oil pipe bullet plug in accordance with claim 1, further comprising:

an input output port pipe to go through center of bullet-shaped plugger comprises a bladder hole, being slightly larger in diameter than the input output port pipe.

28. The high pressure oil pipe bullet plug in accordance with claim 1, further comprising:

a shipboard low pressure oil or a vacuum pump from an input output hose two comprises a bladder stem, having low pressure shipboard oil pump hose connection and a coupler for secure connection with hose.

29. The high pressure oil pipe bullet plug in accordance with claim 1, further comprising:

a sealing of the oil well and supplemental to a valve two near the top of the riser comprises a check valve, being spring loaded and shut off by gushing oil and pressure from the oil well and open by shipboard high pressure oil and having a hinged metallic flap and a strong metal stopper and welded or part of a metal pipe inside.

30. The high pressure oil pipe bullet plug in accordance with claim 1, further comprising:

a cement pump is connected to a cement hose that pours cement on top of a bullet plug when the pump is turned on, and maximum hardening comprises a cement pump and cement having special underwater curing cement.

31. A high pressure oil pipe bullet plug for a high pressure oil pipe hole plugging apparatus that cuts through gushing oil and inflates with oil to facilitate the permanent plugging of an oil well pipe, comprising:

an input port one, being inserted into center of a bladder and pipe-shaped and partially threaded for a nut and having high pressure oil hose connected and a circular opening in center and the outside diameter almost of the inside diameter of the center hole of the bladder and nut to hold a metallic ports containment holder and bladder restraint part, for providing mechanical connection with the a high pressure shipboard oil hose through a coupler to give an output port and nozzle the high pressure oil output to fight and lower the pressure of incoming oil gushing from the well;

a bladder in the static or reduced size state by a shipboard vacuum pump for inserting or descending plugging device into an oil well riser, a same connection for expanding the bladder with oil at a safe amount of pounds per square inch (psi) to plug or shutoff the well from gushing oil while oil stream from the output port and nozzle of the bullet plug continuing to fight the flow from the well;

an input output port two, being flexible and a bidirectional port and having connection to apply a vacuum or pump oil into the bladder and recycled oil from well, a mechanical connection with a low pressure shipboard vacuum and the oil hose for the bladder in the static state or reduced size by the shipboard vacuum pump during its insertion and descending of the plugging device into oil well riser, a same connection for expansion to the bladder with oil at a safe amount of pounds per square inch (psi) to plug or shutoff the well from gushing while oil stream from the output port and nozzle continues fighting the flow from the well;

a coupler one, being high pressure and having secure coupling, for providing secure connection with a high pressure shipboard oil hose;

a coupler two, being a lower pressure than coupler one, for providing secure connection with the low pressure shipboard oil and vacuum pump;

a bladder, being externally and concentrically ribbed and able to sustain high pressure and inflatable by shipboard oil and hollow and donut-shaped and flexible and elongated and contained and secured by containment holder and bladder restraint and having steel-belted multi-ply rubber for strength and gripping power with the bladder expanded and concentric rubber ribs and no buoyancy with the bladder evacuated by vacuum and no buoyancy with the bladder pressurized or filled with oil and collapsed to minimum size or expansion to maximum size for particular oil pipe and different sizes according to pipe size and different strengths and stem for vacuum output and oil input and sufficient space for gushing oil well bypass for inserting and descending into oil well pipe, for providing an oil well bypass with the bladder deflated and blocking or shutting off gushing oil well with the bladder inflated tight by oil to the inside diameter of oil well pipe;

a nosecone and bladder restraint, being contoured bullet-shaped for penetration into incoming oil gusher and metallic and secured by nut and filled with cement for ballast and having strength to withstand opposing external high pressure from oil well and mounting holes inside for electronic assembly and an opening for pressure sensor and output port and nozzle in center, for restraining bladder on one end and assisting with the maximum penetration inside oil well pipe with shape and has a center opening for output port and nozzle attachment;

an output port and nozzle, being secured by a nut and a spot weld and having threads on pipe to screw on nosecone and bladder restraint and inside threads in nozzle and same threads on an output port pipe to fasten nozzle and nozzle that is presetable, for providing the output port and a settable spray pattern for shipboard oil that fights incoming gushing oil from well with oil going through the output port pipe in the center hole of said bladder;

a nut number one, being threaded and having nosecone and bladder restraint secured, for securing nosecone and bladder restraint from screw threads on output port pipe;

a strut, being metallic and attachable to each other and having in sections, for providing struts as sections that assists a bullet-shaped plugging device to install and descend into oil well and pinned at the proper depth;

a pin, being metallic and treaded and having bolt head and threads for nut, for securing strut to riser pipe;

a bypass, being shut off with bullet plug expanded with oil and having no room for oil well oil pressure bypass around bullet shaped plugging device;

a connector, being copper and fiber optic, for giving a connection for sensor on gushing oil well end of bullet-shaped plugging device;

a ports containment holder and bladder restraint, being flanged to mate and hold a bladder and fastened by a large nut and a spot weld and having a hole for center input port and a hole for vacuum and input oil port and a military standard or a fiber optic waterproof connector and a contained and secured bladder at one end for expanding or inflating with oil and a hinged bracket and slot for strut connection, for providing holes for a input ports and a vacuum pump port, and containing and securing bladder at one end not to expand beyond the ports containment holder and bladder restraint thus concentrating the expansion to the sides of the bladder up against the inside of the oil well pipe as tight as possible;

a shipboard oil, being set and controlled by a shipboard pressure readings and having recycled oil from gushing well from a shipboard oil tank, for providing the shipboard oil to fight the oil and oil pressure from a deep water oil well;

a cement hose, being shipboard and ready after the bullet-shaped plugger stops flow of oil and having special type of cement, for providing cement dispensed on top of the bullet-shaped plugger to cure in smaller batches for maximum hardening while the bullet plugger remains expanded and blocking the oil from the gushing oil well;

a high pressure pump, pumping recycled oil from well shipboard pump two, for providing high pressure shipboard oil pump that pumps recycled oil from the well back to the well based on affect of pressure from the oil well to the instrumentation of pump two;

a shipboard pump one, being low pressure and having recycled oil and connection to a bidirectional valve, for pumping of low pressure recycled oil into the bladder to expand and plug gushing oil well and maintaining oil pressure based on a pump one instrumentation and this is with the bidirectional valve switched to pump one and not the vacuum pump;

an input port hose one, being high pressure and flexible and having connection to high pressure oil pump two, for supplying the same oil and oil pressure to the output port and nozzle of bullet-shaped plugging device to fight incoming oil from oil well;

an input output port hose two, being vacuum or oil hose and flexible and having connection to the shipboard bidirectional valve and high pressure rating, for supplying a vacuum from the shipboard vacuum pump or recycled oil from shipboard oil pump to the bladder;

a shipboard vacuum pump, being able to collapse bladder and able to evacuate air and oil and able to remove buoyancy, for evacuating bladder to shrink it to minimum size possible for insertion into oil well pipe;

a shipboard valve one, being turn off valve for high pressure recycled shipboard oil and turn on valve for high pressure recycled oil, for providing turn on and cutoff of high pressure recycled oil from shipboard pump two, rigidly connected to said shipboard pump two;

a well valve two, being turn off valve for high pressure oil coming from shipboard and turn on valve for oil coming from shipboard, for providing turn on and turn off near oil well riser for high pressure recycled oil from shipboard pump two, rigidly connected to said shipboard valve one, and rigidly connected to said ports containment holder and bladder restraint;

a shipboard bidirectional valve, being a switch for oil input to the bladder and a switch for the vacuum output, for providing the switching from shipboard low pressure recycled oil to the bladder of the bullet plug or vacuum to the bladder of the bullet plug, rigidly connected to said shipboard vacuum pump, and rigidly connected to said shipboard pump one;

a well valve four, being cut off valve at well for shipboard pump one and cutoff valve at well for shipboard vacuum pump and inline with an input output port hose two, for providing turn on and turn off near oil well riser for low pressure recycled oil from shipboard pump one or from the shipboard vacuum pump, rigidly connected to said shipboard bidirectional valve, and rigidly connected to said ports containment holder and bladder restraint;

a shipboard oil tank, being shipboard and having recycled oil from well, for providing recycled oil from well to the bullet plugging device bladder and to the high pressure input port of the bullet plugging device for fighting the gushing oil from the well, rigidly connected to said shipboard pump one, and rigidly connected to said shipboard pump two;

strut mounting bolt holes, being a fastener to the bullet plug, for allowing strut to be mounted to ports containment holder and bladder restraint part;

an input output port pipe, being cylindrical and metallic, for providing opening for high pressure oil to fight oil gusher and preventing the bladder from closing off center hole of bullet plugging device, rigidly connected to said ports containment holder and bladder restraint, and rigidly connected to said bladder;

a bladder hole, being slightly larger in diameter than input output port pipe, for allowing input output port pipe to go through center of bullet-shaped plugger;

a bladder stem, having low pressure shipboard oil pump hose connection and coupler for secure connection with hose, for accepting shipboard low pressure oil or vacuum pump from input output hose two;

a check valve, being spring loaded and shut off by gushing oil and pressure from the oil well and open by shipboard high pressure oil and having a hinged metallic flap and a strong metal stopper and welded or part of metal pipe inside, for facilitating the final sealing of the oil well and supplemental to valve two near the top of the riser; and a cement pump, having special underwater curing cement, for pumping cement into plugged oil well pipe in portions for maximum hardening, open-ended hose with no connection for pouring above said ports containment holder and bladder restraint.

32. The high pressure oil pipe bullet plug as recited in claim 31, further comprising:

a nut number two, being a fastener to the nosecone and bladder restraint part, for fastening and securing nosecone and bladder restraint.

33. The high pressure oil pipe bullet plug as recited in claim 31, further comprising:

a system that is made up of commercial-off-the-shelf equipment for shipboard or land needed to support the deployment of a bullet plug for plugging a land or sea out-of-control oil well.

34. The high pressure oil pipe bullet plug as recited in claim 31, further comprising:

a nosecone and bladder restraint 26 screws onto a threaded input output port pipe on one end of the pipe until is hits a stopper or the unthreaded metal on the outside of the input output port pipe, a nut screws onto the outside threads of the input output port pipe and it is spot-welded, a nozzle screws onto the input output port pipe towards the nut.

35. A high pressure oil pipe bullet plug for a high pressure oil pipe hole plugging apparatus that cuts through gushing oil and inflates with oil to facilitate the permanent plugging of an oil well pipe, comprising:

an input output port pipe, being inserted into center of bladder and pipe-shaped and partially threaded for a nut and having a high pressure oil hose connected and a circular opening in center and the outside diameter almost the inside diameter of the center hole of a bladder and a nut to also hold a metallic ports containment holder and bladder restraint part, for providing a mechanical connection with a high pressure shipboard oil hose through a coupler to give an output port and nozzle the high pressure oil output to fight and lower the pressure of incoming oil gushing from the well a bladder in the static or reduced size state by a shipboard vacuum pump for inserting or descending plugging device into oil well riser then a same connection for expanding the bladder with oil at a safe amount of pounds per square inch (psi) to plug or shutoff the well from gushing oil while oil stream from an output port and nozzle of the bullet plug continuing to fight the flow from the well;

an input output port two, being flexible and a bidirectional port and having connection to apply a vacuum or pump oil into bladder and recycled oil from well, for providing mechanical connection with a low pressure shipboard vacuum and oil hose for the bladder in the static state or reduced size by a shipboard vacuum pump during its insertion and descending of the plugging device into an oil well riser then providing the same connection for expansion to the bladder with oil at a safe amount of pounds per square inch (psi) to plug or shutoff the well from gushing oil stream while the output port and nozzle continues fighting the flow from well;

a coupler one, being high pressure and having secure coupling, for providing secure connection with a high pressure shipboard oil hose;

a coupler two, being a lower pressure than coupler one, for providing secure connection with a low pressure shipboard oil and vacuum pump;

a bladder, being externally and concentrically ribbed and able to sustain high enough pressure and inflated by shipboard oil and hollow and donut-shaped and flexible and elongated and contained and secured by a containment holder and bladder restraint and having steel-belted multi-ply rubber for strength and gripping power with bladder expanded and concentric rubber ribs and no buoyancy with bladder evacuated by vacuum and no buoyancy with bladder pressurized or filled with oil and an internal tube or a tubeless and collapsed to minimum size and expansion to maximum size for a particular oil pipe and different sizes according to pipe size and different strengths and stem for vacuum output and oil input oil and sufficient space for gushing oil with a bypass while inserting and descending in oil well pipe, for providing oil well bypass with bladder deflated or blocking or shutting off gushing oil well with bladder inflated tight by oil to the inside diameter of oil well pipe;

a nosecone and bladder restraint, being contoured bullet-shaped for penetration into incoming oil gusher and metallic and secured by nut and filled with cement for ballast and having strength to withstand opposing external high pressure from oil well and mounting holes inside for electronic assembly and an opening for pressure sensor and output port and nozzle in center, for restraining bladder on one end and assisting with the maximum penetration inside oil well pipe with shape and has a center opening for output port and nozzle attachment;

an output port and nozzle, being secured by threads on pipe that also screws on nosecone and bladder restraint and with inside threads in nozzle and same threads on output port to fasten nozzle and nozzle presetable, for providing the output port and settable spray pattern for shipboard oil that fights incoming gushing oil from well, rigidly connected to said output port;

a nut number one, being threaded and having nosecone and bladder restraint secured, for securing a nosecone and bladder restraint from screw threads on output port pipe;

an opening, having a pressure sensor input hole, for giving an opening for sensor stimulus;

a strut, being metallic and attachable to each other and to a hinged connection on the ports containment holder and having in sections, for providing struts as sections that assists bullet-shaped plugging device to install and descend into oil well and pinned at the proper depth;

a pin, being metallic and treaded and having bolt head and threads for a nut, for securing strut to riser pipe;

a riser, having enough opening and thick walls for strength, for providing entrance for bullet-shaped plugger to be inserted;

a bypass, being shut off with bullet plug expanded with oil and having enough room for oil bypass with bullet plug deflated, for facilitating oil well oil and oil pressure bypass around bullet shaped plugging device;

a connector, being copper or fiber optic, for giving a connection for sensor on gushing oil well end of bullet-shaped plugging device;

a ports containment holder and bladder restraint, being flanged to mate and hold bladder and fastened by a large nut and a spot weld and having a hole for center input port and a hole for vacuum and input oil port and military standard or fiber optic waterproof connector and contained and a secured bladder at one end while either expanded or inflated with oil and hinged bracket and slot for strut connection, for providing holes for input ports and vacuum pump port, and containing and securing bladder at one end not to expand beyond the ports containment holder and bladder restraint thus concentrating the expansion to the sides up against the inside of the oil well pipe as tight as possible;

a shipboard oil, being set and controlled by shipboard pressure readings and having recycled oil from gushing well, for providing the shipboard oil to fight the oil and oil pressure from a deep water oil well;

a cement hose, from shipboard and having special type of cement, for providing cement dispensed on top of a bullet-shaped plugger to cure in smaller batches for maximum hardening while bullet plugger is expanded and blocking the oil from the gushing oil well;

a high pressure, pumping recycled oil from well a shipboard pump two, for providing high pressure shipboard oil pump that pumps recycled oil from the well back to the well based on affect of pressure from the oil well to the instrumentation of pump two;

a shipboard pump one, being low pressure and having recycled oil and connection to a bidirectional valve, for facilitating the pumping of low pressure recycled oil into bladder to expand and plug gushing oil well maintaining oil pressure based on pump one instrumentation and with the bidirectional valve switched to pump one and not vacuum pump;

an input port hose one, being high pressure and flexible and having connection to high pressure oil pump two, for supplying the same oil and oil pressure to the output port and nozzle of bullet-shaped plugging device to fight incoming oil from oil well;

an input output port hose two, being vacuum or oil hose and flexible and having connection to shipboard bidirectional valve and high pressure rating, for supplying a vacuum from shipboard vacuum pump or recycled oil from shipboard oil pump to the bladder;

a shipboard vacuum pump, being able to collapse bladder or able to evacuate air and oil and able to remove buoyancy, for evacuating bladder to shrink it to minimum size possible for insertion into oil well pipe;

a shipboard valve one, being turn off valve for high pressure recycled shipboard oil and turn on valve for high pressure recycled oil, for providing turn on and cutoff of high pressure recycled oil from a shipboard pump two, rigidly connected to said shipboard pump two;

a well valve two, being turn off valve for high pressure oil coming from shipboard and turn on valve for oil coming from shipboard, for providing turn on and turn off near oil well riser for high pressure recycled oil from shipboard pump two, rigidly connected to said shipboard valve one, and rigidly connected to said ports containment holder and bladder restraint;

a shipboard bidirectional valve, being a switch for oil input to the bladder and a switch for vacuum output, for providing the switching from shipboard low pressure recycled oil to the bladder of the bullet plug or a vacuum to the bladder of the bullet plug, rigidly connected to said shipboard vacuum pump, and rigidly connected to said shipboard pump one;

a well valve four, being cut off valve at well for shipboard pump one and cutoff valve at well for shipboard vacuum pump and inline with input output port hose two, for providing turn on and turn off near oil well riser for low pressure recycled oil from shipboard pump one or from shipboard vacuum pump, rigidly connected to said shipboard bidirectional valve, and rigidly connected to said ports containment holder and bladder restraint;

a shipboard oil tank, being shipboard and having recycled oil from well, for providing recycled oil from well to the bullet plugging device and to the high pressure input port of the bullet plugging device for fighting the gushing oil from the well, rigidly connected to said shipboard pump one, and rigidly connected to said shipboard pump two;

a cable, being copper or fiber optic, for giving a connection to pressure sensor located in the nosecone and bladder restraint;

strut mounting bolts, being a fastener to the bullet plug, for allowing a strut to be mounted to ports containment holder and bladder restraint part;

an input output port pipe, being cylindrical and metallic, for providing opening for high pressure oil to fight oil gusher and preventing the bladder from closing off center hole of bullet plugging device, rigidly connected to said ports containment holder and bladder restraint, and rigidly connected to said bladder;

a bladder hole, being slightly larger in diameter than input output port pipe, for allowing input output port pipe to go through center of bullet-shaped plugger;

a bladder stem, having low pressure shipboard oil pump hose connection and coupler for secure connection with hose, for accepting shipboard low pressure oil or vacuum pump from input output hose two;

a nut number two, being a fastener to the nosecone and bladder restraint part, for fastening and securing nosecone and bladder restraint;

a check valve, being spring loaded and shut off by gushing oil and pressure from the oil well and open by shipboard high pressure oil and having a hinged metallic flap and a strong metal stopper and welded or part of metal pipe inside, for facilitating the final sealing of the oil well and supplemental to valve two near the top of the riser;

a cement pump, having special underwater curing cement, for pumping cement into plugged oil well pipe in portions for maximum hardening, rigidly connected to hoses going to said ports containment holder and bladder restraint.

* * * * *